US007490561B1

(12) United States Patent
Chou

(10) Patent No.: US 7,490,561 B1
(45) Date of Patent: Feb. 17, 2009

(54) PALLET ASSEMBLY

(76) Inventor: Huang Jung Chou, 250 Tong-Men Road, Section 3 (TW)

( * ) Notice: Subject to any disclaimer, the term of this patent is extended or adjusted under 35 U.S.C. 154(b) by 0 days.

(21) Appl. No.: 12/009,990

(22) Filed: Jan. 24, 2008

(51) Int. Cl.
*B65D 19/12* (2006.01)

(52) U.S. Cl. ..... 108/56.1; 108/56.3; 108/902

(58) Field of Classification Search ..... 108/51.11, 108/57.25, 56.1, 56.3, 57.12, 55.3, 55.1, 108/901, 902
See application file for complete search history.

(56) References Cited

U.S. PATENT DOCUMENTS

| | | | | | |
|---|---|---|---|---|---|
| 2,783,960 | A * | 3/1957 | Herz et al. | ..... | 108/56.1 |
| 3,675,595 | A * | 7/1972 | Sullivan | ..... | 108/55.5 |
| 4,051,787 | A * | 10/1977 | Nishitani et al. | ..... | 108/55.3 |
| 4,128,253 | A * | 12/1978 | Powers | ..... | 108/55.1 |
| 4,397,246 | A * | 8/1983 | Ishida et al. | ..... | 108/55.3 |
| 5,329,862 | A * | 7/1994 | Breezer et al. | ..... | 108/55.5 |
| 5,413,052 | A * | 5/1995 | Breezer et al. | ..... | 108/56.1 |
| 5,417,167 | A * | 5/1995 | Sadr | ..... | 108/57.19 |
| 5,456,189 | A * | 10/1995 | Belle Isle | ..... | 108/57.17 |
| 5,458,069 | A * | 10/1995 | Stolzman | ..... | 108/56.3 |
| 5,673,629 | A * | 10/1997 | Ginnow | ..... | 108/56.1 |
| 5,941,179 | A * | 8/1999 | Herring | ..... | 108/56.3 |
| 6,021,721 | A * | 2/2000 | Rushton | ..... | 108/56.3 |
| 6,216,608 | B1 * | 4/2001 | Woods et al. | ..... | 108/57.25 |
| 6,837,170 | B2 * | 1/2005 | Taft | ..... | 108/57.25 |
| 6,974,140 | B2 * | 12/2005 | Neuman | ..... | 108/55.1 |
| 7,004,083 | B2 * | 2/2006 | Ramirez von Holle et al. | ... | 108/57.25 |
| 7,197,989 | B2 | 4/2007 | Apps | | |
| 7,216,592 | B2 | 5/2007 | Kroch | | |
| 7,258,319 | B2 | 8/2007 | Johnson | | |
| 7,273,014 | B2 | 9/2007 | Adedeji et al. | | |
| 7,275,489 | B1 | 10/2007 | Shuert | | |
| 2005/0268824 | A1 * | 12/2005 | Williams, Jr. | ..... | 108/57.25 |

* cited by examiner

*Primary Examiner*—José V Chen
(74) *Attorney, Agent, or Firm*—William G. Sykes

(57) ABSTRACT

A pallet assembly has multiple supporting ties and multiple top deck panels. The supporting ties are placed at intervals and are parallel to each other. Each supporting tie has multiple top mounting holes. The top mounting holes are formed in a top of the supporting tie. The top deck panels are elongated, are mounted on the tops of the supporting ties and are perpendicular to the supporting ties. Each top deck panel has multiple mounting pins. The mounting pins protrude down from a bottom of the top deck panel and are respectively and securely mounted in the top mounting holes. The top deck panels can be rapidly assembled with the supporting ties and are protected from sliding relatively to the supporting ties so that a structure of the pallet assembly is firm.

8 Claims, 8 Drawing Sheets

PALLET ASSEMBLY

BACKGROUND OF THE INVENTION

1. Field of the Invention

The present invention relates to a pallet assembly, and more particularly to a pallet assembly that can be rapidly and conveniently assembled and has a firm structure.

2. Description of Related Art

With reference to FIG. 6, a conventional pallet assembly has multiple supporting ties and multiple deck panels. The supporting ties are placed at intervals and are parallel to each other. Each supporting tie has a top, a bottom and multiple mounting slots. The mounting slots are respectively formed in the top and the bottom of the supporting tie at intervals and respectively align with the mounting slots in other supporting ties. Each mounting slot has two indented side walls opposite to each other. The deck panels are elongated, are respectively mounted in the aligned mounting slots in the supporting ties and are parallel to each other. Each deck panel has two projected sides opposite to each other. The projected sides of the deck panel respectively correspond to and are held by the indented side walls in the mounting slots. Thus, the deck panels are prevented from detaching from the mounting slots.

However, the mounting slots with two indented side walls cause a structure of the supporting tie that is complicated and hard to be manufactured. Additionally, the deck panels may slide relatively to the supporting ties and easily detach from the mounting slots.

With further reference to FIGS. 7 and 8, another conventional pallet assembly has multiple supporting ties and multiple deck panel assemblies. The supporting ties are placed at intervals and are parallel to each other. Each supporting tie has a dovetail-like top end and a dovetail-like bottom end. The deck panel assemblies are mounted to the supporting ties at intervals and are parallel to each other. Each deck panel assembly has multiple connectors and a deck panel. The connectors are respectively mounted on the supporting ties. Each connector has a top, a bottom, a bottom dovetail-like slot and a top dovetail-like slot. The bottom dovetail-like slot is formed longitudinally in the bottom of the connector and corresponds to and holds the dovetail-like top end of a corresponding supporting tie. The top dovetail-like slot is formed transversely in the top of the connector. The deck panel is elongated, is mounted through the top dovetail-like slots of corresponding connectors and has a dovetail-like bottom end. The dovetail-like bottom end of the deck panel corresponds to and is held to the top dovetail-like slots in the connectors. Thus, the deck panels are prevented from detaching from the supporting ties.

However, the deck panels can not be directly mounted on the supporting ties. To assemble the connectors onto the supporting ties and to assemble the deck panels with the connectors to form a complete pallet is inconvenient and time-consuming. Therefore, the conventional pallet assembly does not have an acceptable practicality.

Further, relative movements may exist between the supporting ties and the connectors or between the connectors and the deck panels. Thus, the pallet assembly does not have a stable or firm structure.

SUMMARY OF THE INVENTION

The primary objective of the present invention is to provide a pallet assembly to mitigate or obviate the problems of the conventional pallet assemblies.

The pallet assembly has multiple supporting ties and multiple top deck panels. The supporting ties are placed at intervals and are parallel to each other. Each supporting tie has a top and multiple top mounting holes. The top mounting holes are formed in the top of the supporting tie. The top deck panels are elongated, are mounted on the tops of the supporting ties, are perpendicular to the supporting ties and are parallel to each other. Each top deck panel has a bottom and multiple mounting pins. The mounting pins protrude down from the bottom of the top deck panel and are respectively and securely mounted in the top mounting holes.

By mounting the mounting pins into the top mounting holes, the top deck panels can be rapidly and conveniently mounted on the supporting ties to form a complete pallet assembly and relative slip between the top deck panels and the supporting ties are prevented. Therefore, the pallet assembly has a firm structure.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
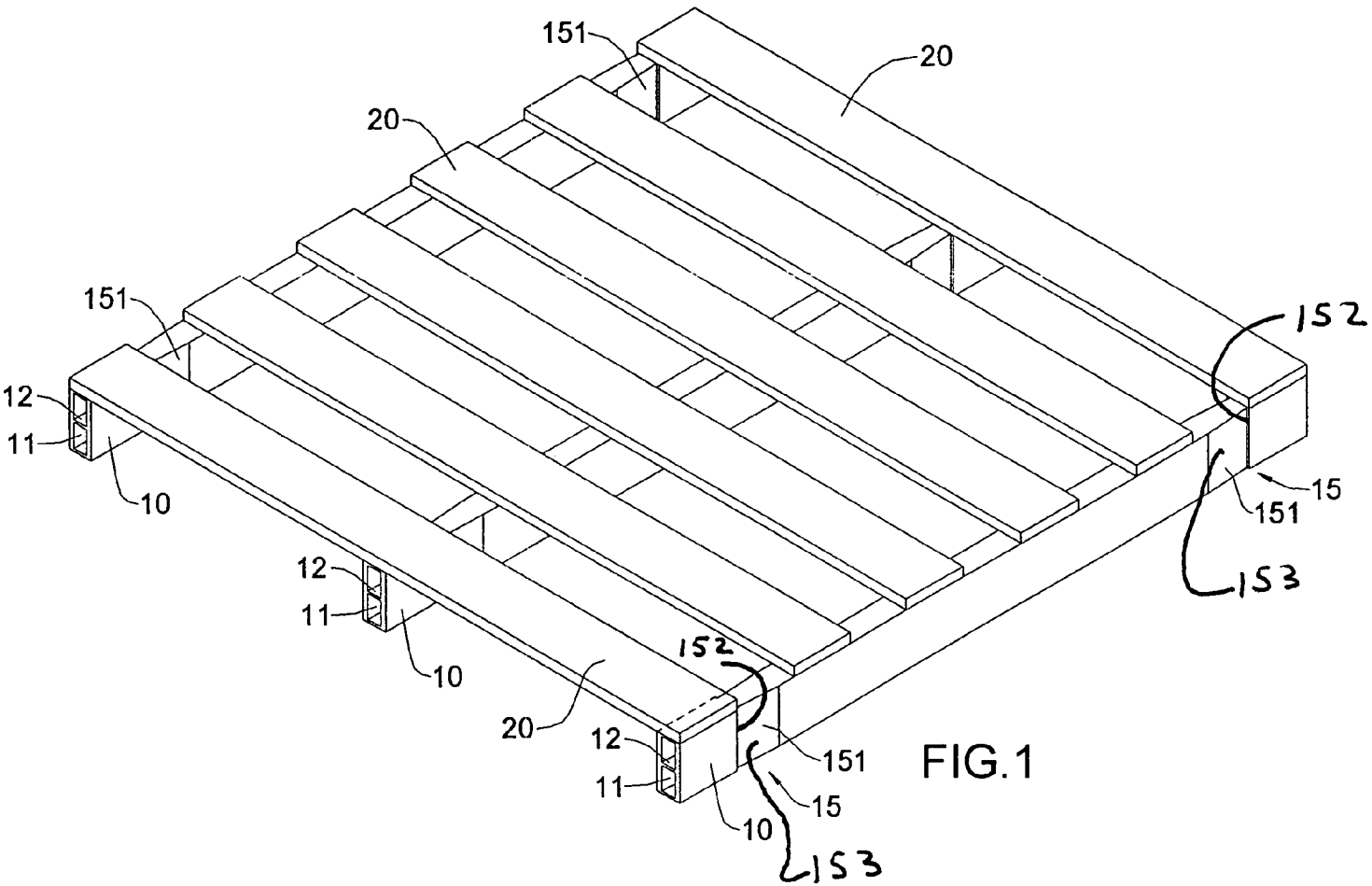
FIG. 1 is a perspective view of a first embodiment of a pallet assembly in accordance with the present invention.
Figure 2:
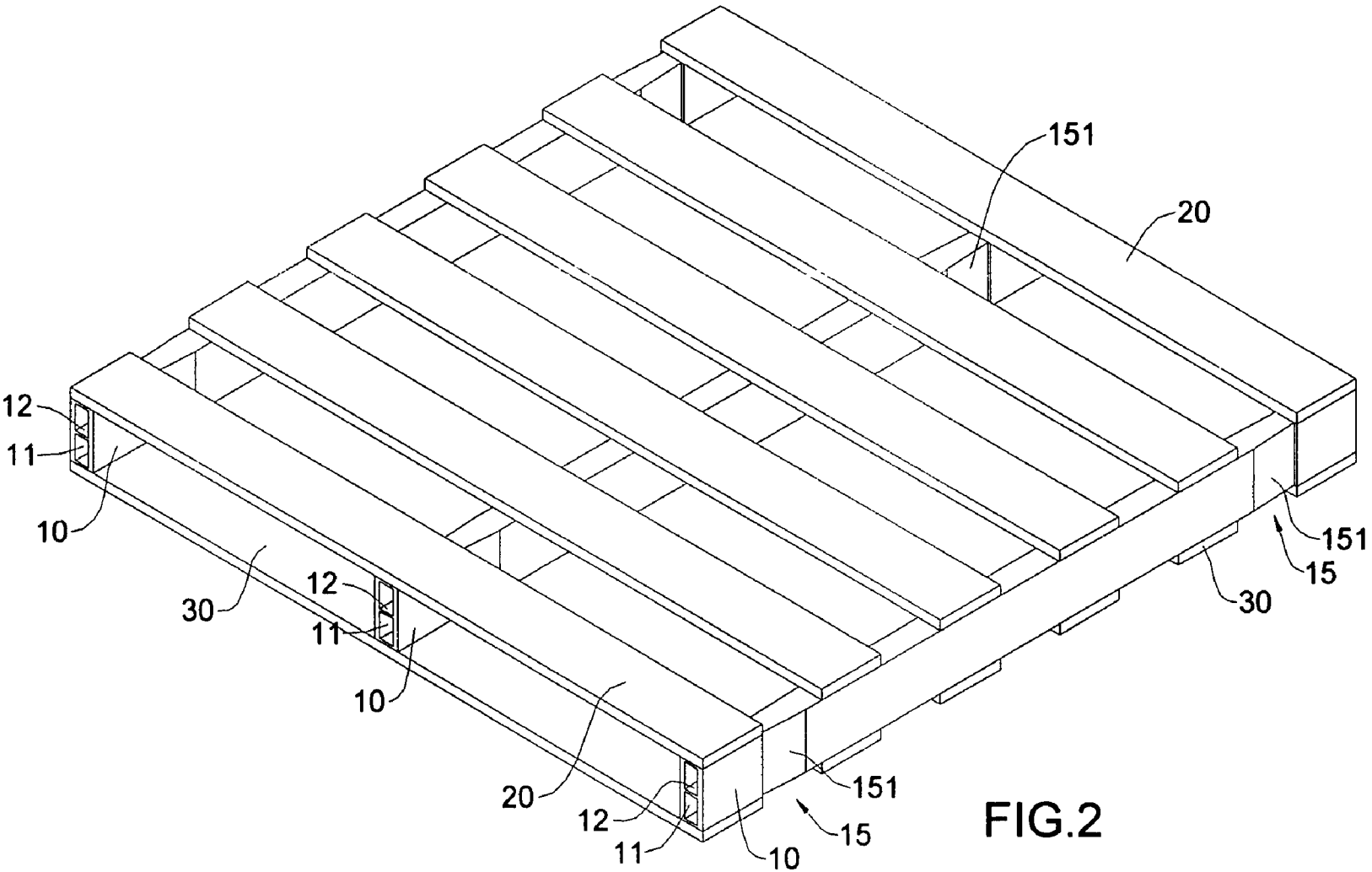
FIG. 2 is a perspective view of a second embodiment of a pallet assembly in accordance with the present invention with multiple bottom deck panels mounted on bottoms of multiple supporting ties.

With reference to FIGS. 1 and 2, a pallet assembly comprises multiple supporting ties (10), multiple top deck panels (20) and multiple bottom deck panels (30).

Figure 3:
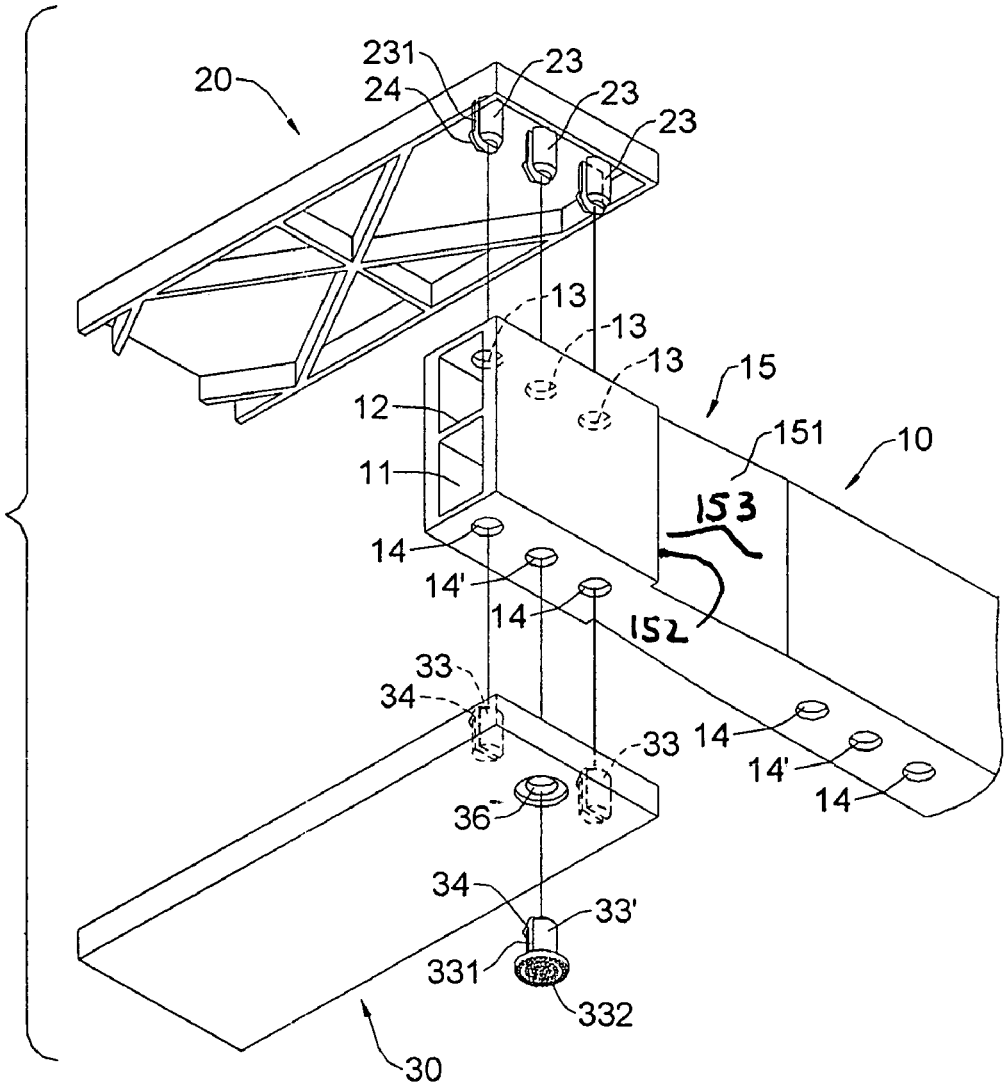
FIG. 3 is an enlarged exploded perspective view of the pallet assembly in FIG. 2.

With further reference to FIG. 3, the supporting ties (10) are placed at intervals and are parallel to each other. Each supporting tie (10) has a top, a bottom, two sides, two ends, multiple top mounting holes (13), multiple bottom mounting holes (14,14'), two hooking notch assemblies (15), an elongated slot (11) and may be made of plastic. The top mounting holes (13) are formed in the top of the supporting tie (10) and each top mounting hole (13) has a diameter. The bottom mounting holes (14,14') are formed in the bottom of the supporting tie (10) and each bottom mounting hole (14,14') has a diameter. The bottom mounting holes (14,14') may include multiple characteristic bottom mounting holes (14').

The hooking notch assemblies (15) are respectively formed near the two ends of the supporting tie (10) and each hooking notch assembly (15) has two hooking notches (151). The hooking notches (151) are formed in the two sides of the supporting tie (10) and are opposite to each other. As best seen in FIGS. 1 and 3, each hooking notch 151 has a vertical wall 152 disposed perpendicular to the side of supporting tie 10 and extending from the top surface to the bottom surface thereof. Vertical wall 152 is disposed nearest the respective end of supporting tie 10. An inner surface 153 is contiguous with vertical surface 152 and is disposed at an acute angle with respect thereto. Inner surface 153 also extends from said top surface and said bottom surface of supporting tie 10. Thus, a worker can use a hooked tool to clasp vertical wall 152 of hooking notches (151) to draw the supporting tie (10) to conveniently pull out the entire pallet assembly. Each hooking notch (151) may be wedge-shaped to be easily clasped by a hooked tool.

The elongated slot (11) is formed longitudinally through the supporting tie (10) for saving material for the supporting tie (10) and has two opposite side walls and at least one partition rib (12). There is at least one partition rib (12) that is formed longitudinally in the elongated slot (11) and divides the elongated slot (11) into multiple minor slots to enhance a structural strength of the supporting tie (10). Each partition rib (12) may have two ends respectively formed on the opposite side walls of the elongated slot (11).

Figure 4:
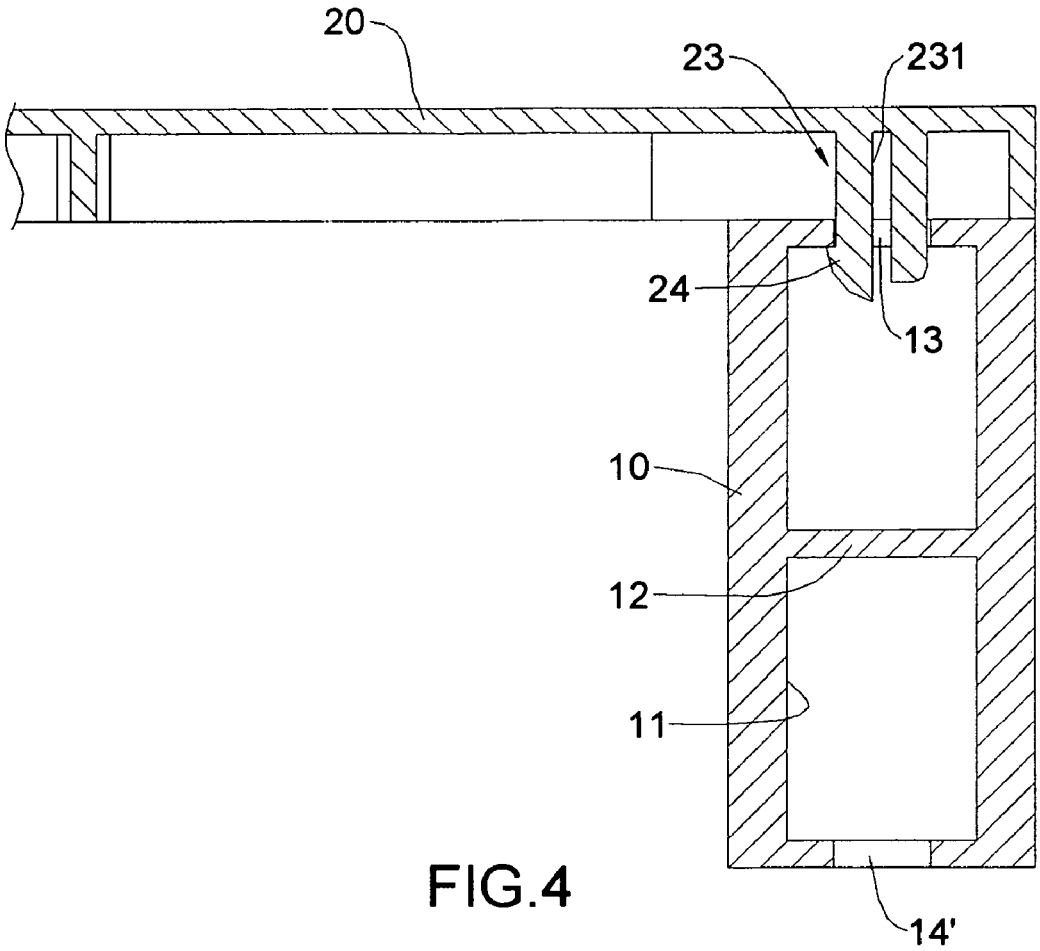
FIG. 4 is an enlarged cross-sectional side view of the pallet assembly in FIG. 1.

With further reference to FIG. 4, the top deck panels (20) are elongated, are mounted on the tops of the supporting ties (10), are perpendicular to the supporting ties (10), are parallel to each other and may be substantially made of plastic. The parallel top deck panels (20) provide a flat surface for stacking cargos so that the worker can drive a forklift up and into the pallet assembly to conveniently carry the cargos to a destination. Each top deck panel (20) has a bottom and multiple mounting pins (23).

The mounting pins (23) protrude down from the bottom of the top deck panel (20), are respectively and securely mounted in the top mounting holes (13) in the tops of the supporting ties (10) and may be formed integrally on the bottom of the top deck panel (20). Each mounting pin (23) has an outer wall, a retaining rim (24) and a cutting slot (231). The retaining rim (24) is formed on and protrudes from the outer wall of the mounting pin (23) and has a diameter slightly larger than that of the top mounting hole (13). Thus, the retaining rim (24) can be forced into the top mounting hole (13) to securely mount the mounting pin (23) in the top mounting hole (13). The cutting slot (231) is formed longitudinally through the outer wall of the mounting pin (23) so that the retaining rim (24) can be easily forced into the top mounting hole (13).

By mounting the mounting pins (23) into the top mounting holes (13), the top deck panels (20) can be easily and rapidly mounted on the tops of the supporting ties (10). Further, the retaining rims (24) hold the mounting pins (23) securely in the mounting holes (13) to ensure a firm structure of the pallet assembly. Additionally, the top deck panels (20) are prevented from sliding relatively to the supporting ties (10).

Figure 5:
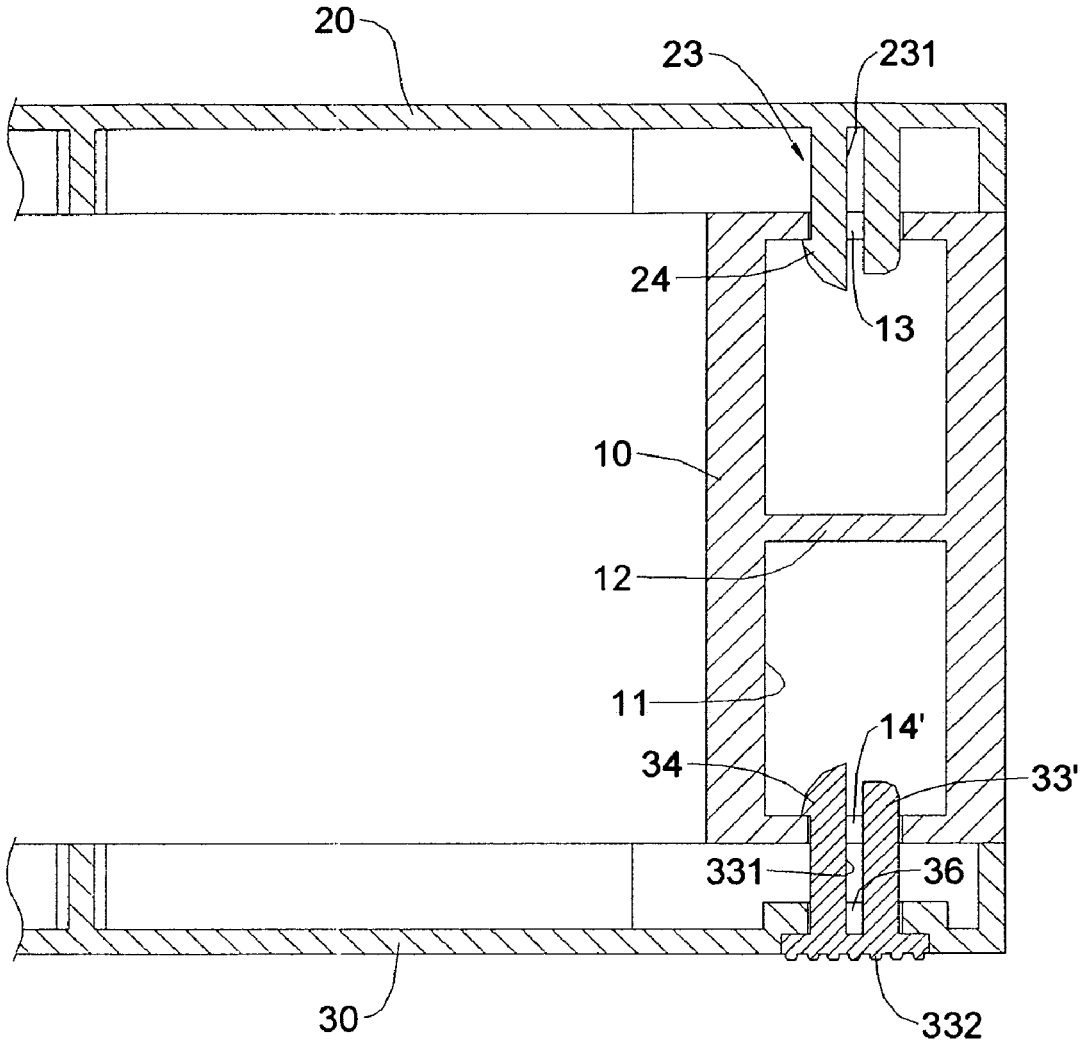
FIG. 5 is an enlarged cross-sectional side view of the pallet assembly in FIG. 2.
Figure 6:
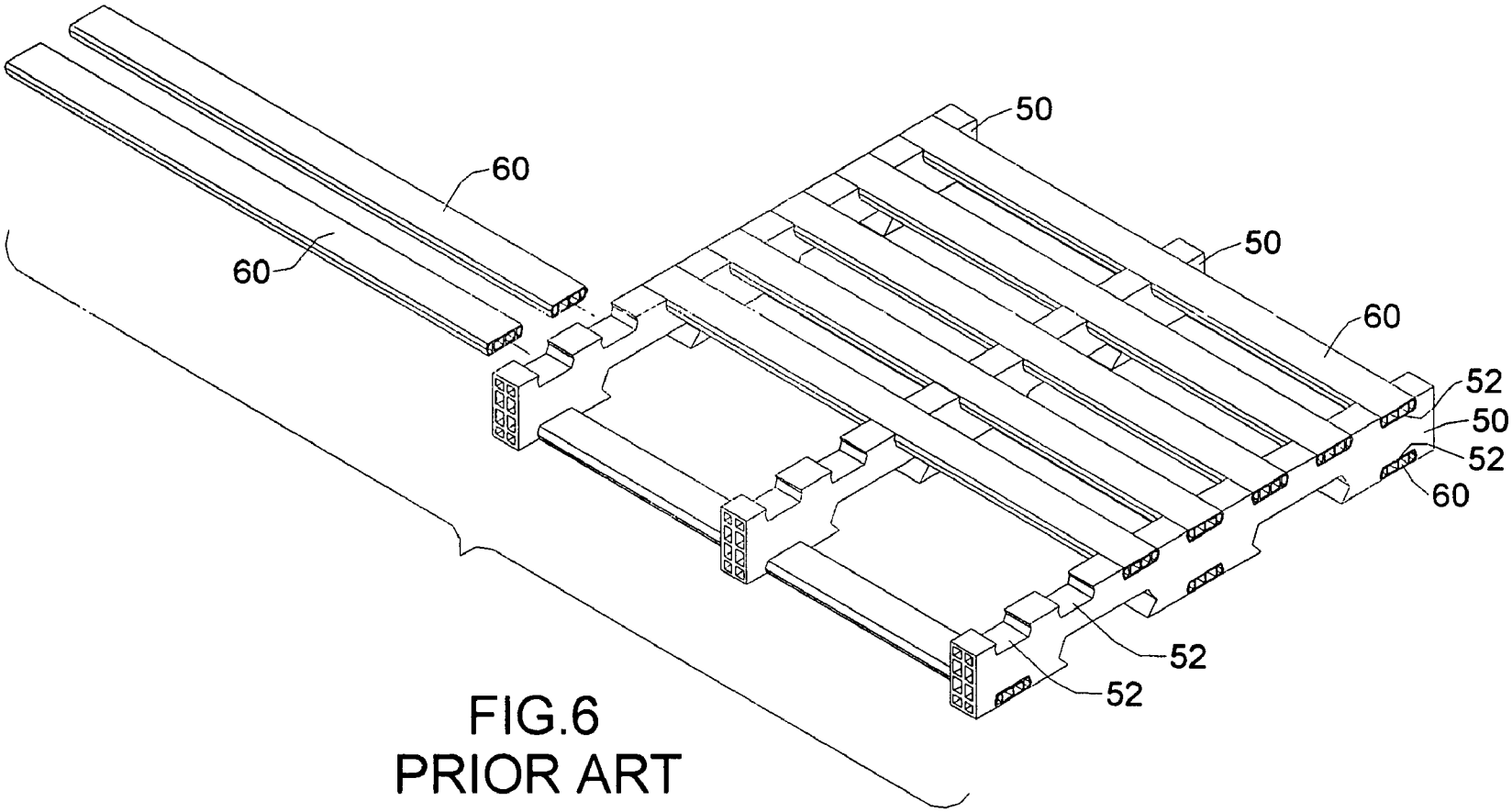
FIG.6 PRIOR ART
FIG. 6 is an exploded perspective view of a conventional pallet assembly in accordance with the prior art with two deck panels detached off.
Figure 7:
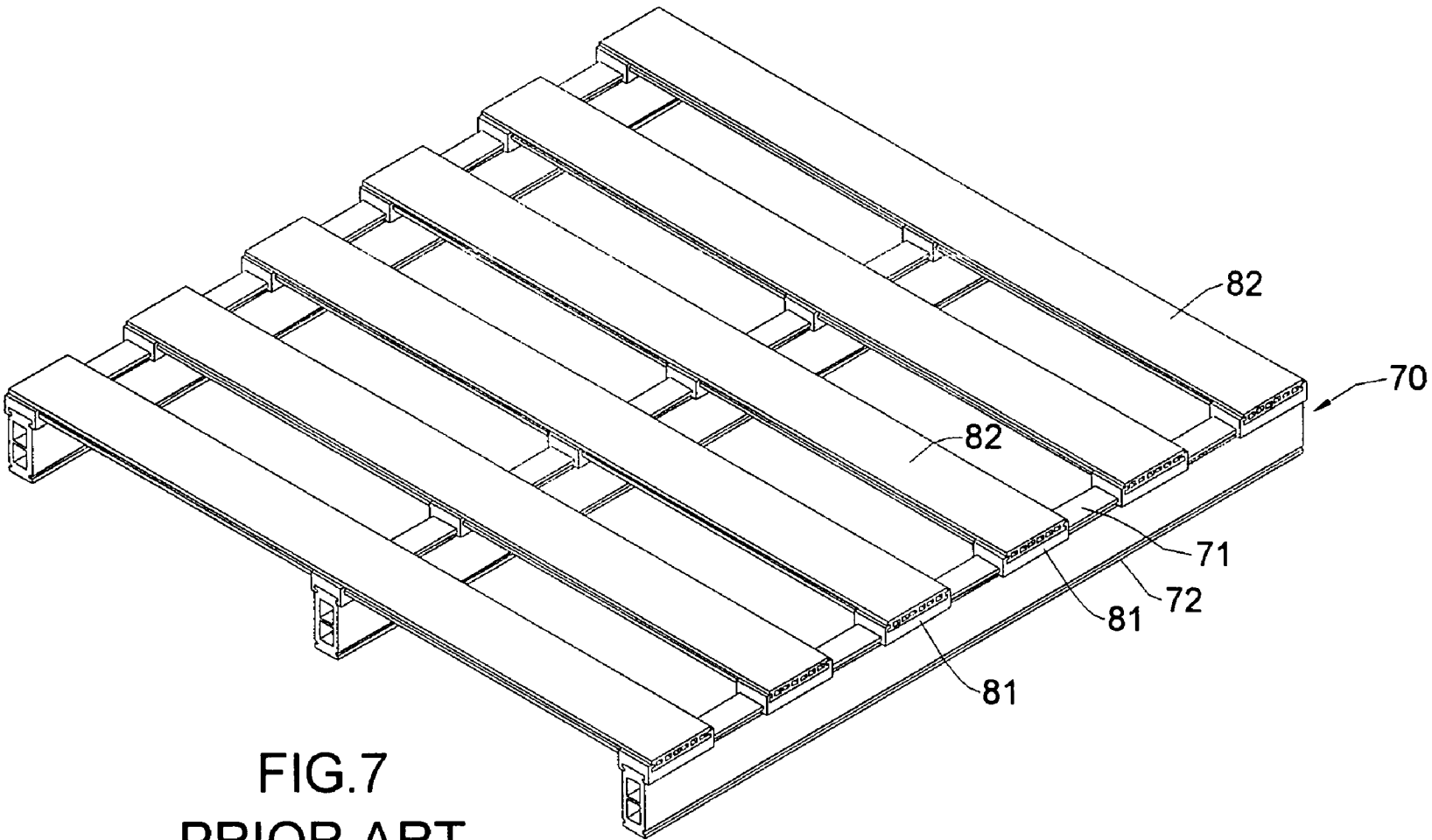
FIG.7 PRIOR ART
FIG. 7 is a perspective view of another conventional pallet assembly in accordance with the prior art.
Figure 8:
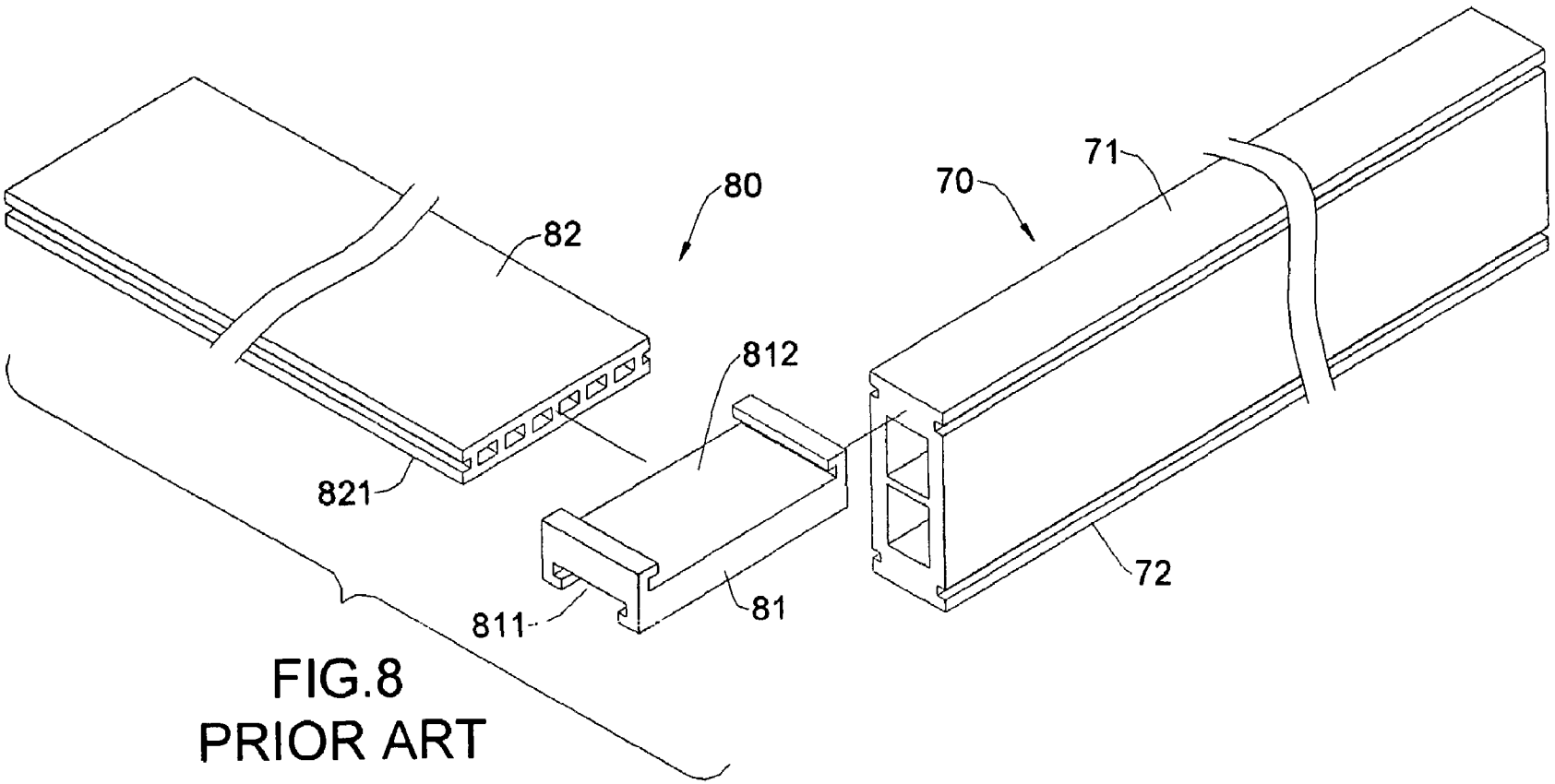
FIG.8 PRIOR ART
FIG. 8 is an enlarged exploded perspective view of the pallet assembly in FIG. 7.

With further reference to FIG. 5, the bottom deck panels (30) are elongated, are mounted on the bottom of the supporting ties (10), are perpendicular to the supporting ties (10), are parallel to each other and may be substantially made of plastic. Each bottom deck panel (30) has a top, multiple positioning holes (36) and multiple mounting pins (33, 33').

The positioning holes (36) are formed through the bottom deck panel (30) and align with the characteristic bottom mounting holes (14') in the bottoms of the supporting ties (10).

The mounting pins (33,33') protrude up from the top of the bottom deck panel (30), are respectively and securely mounted in the bottom mounting holes (14,14') in the bottoms of the supporting ties (10) and may include multiple characteristic mounting pins (33'). Each mounting pin (33,33') has an outer wall, a retaining rim (34) and a cutting slot (331). The retaining rim (34) is formed on and protrude from the outer wall of the mounting pin (33,33') and has a diameter slightly larger than that of the bottom mounting hole (14,14'). Thus, the retaining rim (34) can be forced into the bottom mounting hole (14,14') to securely mount the mounting pin (33,33') in the mounting hole (14,14'). The cutting slot (331) is formed longitudinally through the outer wall of the mounting pin (33,33') so that the retaining rim (34) can be easily forced into the bottom mounting hole (14, 14').

By mounting the mounting pins (33,33') into the top mounting holes (14, 14'), the bottom deck panels (30) can be easily and rapidly mounted on the bottoms of the supporting ties (10). Additionally, the retaining rims (34) hold the mounting pins (33, 33') securely in the mounting holes (13) to further enhance the structure of the pallet assembly. Also, the bottom deck panels (30) are prevented from sliding relatively to the supporting ties (10). Furthermore, cargos also can be stacked on the bottom deck panels (30) when the pallet assembly is turned upside down.

The characteristic mounting pins (33') are respectively mounted through the positioning holes (36) in the bottom deck panel (30), respectively aligns with the characteristic bottom mounting holes (14') in the bottoms of the supporting ties (10) and may be made of rubber. Each characteristic mounting pin (33') has a top end, a bottom surface and multiple skidproof protrusions (332). The top end of the characteristic mounting pin (33') protrudes up from the top of the bottom deck panel (30) and extends into a corresponding characteristic bottom mounting hole (14'). The bottom surface of the characteristic mounting pin (33') is flush with the bottom of the bottom deck panel (30). The skidproof protrusions (332) are formed on and protrude from the bottom surface of the characteristic mounting pin (33') for contacting with the ground to provide enough friction to prevent relative slip between the bottom deck panel (30) and the ground.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pallet assembly comprising:

a) a plurality of supporting ties being placed at intervals and parallel to each other, each of said plurality of supporting tie having: a top surface; a bottom surface parallel to said top surface; two parallel side surfaces disposed orthogonally to said top surface and said bottom surface; and a proximal and a distal end;

b) groups of three mounting holes formed in the top surface of each of said multiple supporting ties, each one of said group of three mounting hole having a diameter;

c) a plurality of elongated top deck panels mounted parallel to one another on said top surfaces of said plurality of supporting ties, perpendicular to said plurality of supporting ties and each of said plurality of top deck panels having a bottom surface comprising multiple mounting pins, each having an outer wall, protruding outwardly therefrom for engageable interaction with said groups of three mounting holes in said top surfaces of said plurality of said plurality of supporting ties; and d) at least one pair of wedge-shaped hooking notches symmetrically disposed in opposing ones of said parallel side surfaces and proximate at least one of said proximal end and said distal end of at least one of said plurality of supporting ties, each of said at least one pair of hooking notches comprising a vertical surface perpendicular to a respective side surface and extending inwardly therefrom, said vertical surface extending from said top surface to said bottom surface; and an inner surface contiguous with said vertical surface and disposed at an acute angle with respect thereto, said inner surface also extending from said top surface and said bottom surface, said vertical surface being adapted and configured to receive and temporarily retain a hook.

2. The pallet assembly as claimed in claim 1, wherein:

each supporting tie further has multiple bottom mounting holes formed in the bottom of the supporting tie and each bottom mounting hole has a diameter; and the pallet assembly further comprises: multiple bottom deck panels being elongated, mounted on the bottom of the supporting ties, perpendicular to the supporting ties and parallel to each other, and each bottom deck panel having a top; and multiple mounting pins protruding up from the top of the bottom deck panel, respectively and securely mounted in corresponding bottom mounting holes in the bottoms of the supporting ties.

3. The pallet assembly as claimed in claim 2, wherein the bottom mounting holes in each supporting tie include multiple characteristic bottom mounting holes;

each bottom deck panel further has multiple positioning holes formed through the bottom deck panel and aligning with corresponding characteristic bottom mounting holes included in the corresponding bottom mounting holes in the bottoms of the supporting ties;

the mounting pins of each bottom deck panel include multiple characteristic mounting pins respectively mounted through the positioning holes in the bottom deck panel and respectively aligning with the corresponding characteristic bottom mounting holes in the supporting ties and each characteristic mounting pin having a top end protruding up from the top of the bottom deck panel and extending into a corresponding characteristic bottom mounting hole; a bottom surface being flush with the bottom of the bottom deck panel; and multiple skidproof protrusions formed on and protruding from the bottom surface of the characteristic mounting pin.

4. The pallet assembly as claimed in claim 3, wherein each mounting pin of the top deck panels further has a retaining rim formed on and protruding from the outer wall of the mounting pin and having a diameter slightly larger than that of a corresponding top mounting hole to be forced into the top mounting hole; and each mounting pin of the bottom deck panels further has a retaining rim formed on and protruding from the outer wall of the mounting pin and having a diameter slightly larger than that of a corresponding bottom mounting hole to be forced into the bottom mounting hole.

5. The pallet assembly as claimed in claim 4, wherein each mounting pin of the top deck panels further has a cutting slot formed longitudinally through the outer wall of the mounting pin; and each mounting pin of the bottom deck panels further has a cutting slot formed longitudinally through the outer wall of the mounting pin.

6. The pallet assembly as claimed in claim 1, wherein each support tie further has an elongated slot formed longitudinally through the supporting tie and having two opposite side walls, and at least one partition rib formed longitudinally in the elongated slot and dividing the elongated slot into multiple minor slots.

7. The pallet assembly as claimed in claim 1, wherein each hooking notch is wedge-shaped.

8. The pallet assembly as claimed in claim 1, wherein the mounting pins of each top deck panel are formed integrally on the bottom of the top deck panel.

* * * * *